US009874102B2

(12) United States Patent
Azad et al.

(10) Patent No.: US 9,874,102 B2
(45) Date of Patent: Jan. 23, 2018

(54) COOLED TURBINE VANE PLATFORM COMPRISING FORWARD, MIDCHORD AND AFT COOLING CHAMBERS IN THE PLATFORM

(71) Applicant: Siemens Energy, Inc., Orlando, FL (US)

(72) Inventors: Gm Salam Azad, Oviedo, FL (US); Ching-Pang Lee, Cincinnati, OH (US); Alan A. Thrift, Charlotte, NC (US); Daniel Joo, Oviedo, FL (US); Johan K. Westin, Orlando, FL (US); Caleb Myers, Cincinnati, OH (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/507,779

(22) PCT Filed: Sep. 8, 2014

(86) PCT No.: PCT/US2014/054459
§ 371 (c)(1),
(2) Date: Mar. 1, 2017

(87) PCT Pub. No.: WO2016/039714
PCT Pub. Date: Mar. 17, 2016

(65) Prior Publication Data
US 2017/0248024 A1 Aug. 31, 2017

(51) Int. Cl.
*F01D 25/12* (2006.01)
*F01D 5/18* (2006.01)
(Continued)

(52) U.S. Cl.
CPC ..... *F01D 5/187* (2013.01); *F01D 5/12* (2013.01); *F01D 5/14* (2013.01); *F01D 5/18* (2013.01);
(Continued)

(58) Field of Classification Search
CPC ... F01D 5/187; F01D 5/12; F01D 5/14; F01D 5/18; F01D 9/04; F01D 25/08; F01D 25/12; F05D 2240/81; F05D 2260/2212
See application file for complete search history.

(56) References Cited

U.S. PATENT DOCUMENTS 5,344,283 A * 9/1994 Magowan ..... F01D 5/187 415/115
5,413,458 A 5/1995 Calderbank
(Continued)

FOREIGN PATENT DOCUMENTS

CN 103089330 A 5/2013
DE 102006004437 A1 11/2006
(Continued)

OTHER PUBLICATIONS

PCT International Search Report and Written Opinion dated Dec. 5, 2014 corresponding to PCT Application PCT/US2014/054459 filed Sep. 8, 2014.

*Primary Examiner* — Richard Edgar

(57) ABSTRACT

A cooling system (10) positioned within a turbine airfoil (12) and having film cooling channels (16) positioned within inner and outer endwalls (18, 20) of the turbine airfoil (12), with cooling fluids supplied to the cooling channels (16) other than from an aft cooling chamber (22) to prevent blockages from developing within the film cooling channels (16) from debris that typically collects with the aft cooling chamber (22) during steady state operation of the turbine engine is disclosed. The cooling system (10) may include one or more midchord cooling channels (24) extending from
(Continued)

a midchord cooling chamber (26) and including an outlet (28) positioned closer to a downstream edge (30) of the inner endwall (18) than an upstream wall (32) forming the aft cooling chamber (22). The midchord cooling channel, thus, may cool aspects of the inner endwall (18) radially outward of the aft cooling chamber (22) without receiving cooling fluid from aft cooling chamber (22), thereby eliminating the possibility of blockages from debris in the aft cooling chamber (22).

12 Claims, 7 Drawing Sheets

(51) Int. Cl.

| | |
|---|---|
| *F01D 25/08* | (2006.01) |
| *F01D 9/04* | (2006.01) |
| *F01D 5/12* | (2006.01) |
| *F01D 5/14* | (2006.01) |

(52) U.S. Cl.
CPC ..... *F01D 9/04* (2013.01); *F01D 25/08* (2013.01); *F01D 25/12* (2013.01); *F05D 2240/81* (2013.01); *F05D 2260/2212* (2013.01)

(56) References Cited

U.S. PATENT DOCUMENTS

| | | | |
|---|---|---|---|
| 6,155,778 | A | 12/2000 | Lee et al. |
| 6,196,792 | B1 | 3/2001 | Lee et al. |
| 6,354,795 | B1 | 3/2002 | White et al. |
| 6,379,528 | B1 | 4/2002 | Lee et al. |
| 7,387,488 | B2 | 6/2008 | Nichols et al. |
| 7,438,520 | B2 | 10/2008 | Ruthemeyer et al. |
| 7,448,846 | B2 | 11/2008 | Ruthemeyer et al. |
| 7,452,183 | B2 | 11/2008 | Ruthemeyer et al. |
| 7,604,453 | B2 | 10/2009 | Lee et al. |
| 7,665,953 | B2 | 2/2010 | Lee et al. |
| 7,690,885 | B2 | 4/2010 | Lee et al. |
| 7,722,315 | B2 | 5/2010 | Lee et al. |
| 7,740,442 | B2 | 6/2010 | Lee et al. |
| 8,104,292 | B2 | 1/2012 | Lee et al. |
| 8,147,192 | B2 | 4/2012 | Jones et al. |
| 2007/0031240 | A1 | 2/2007 | Nichols |
| 2007/0031243 | A1 | 2/2007 | Ruthemeyer et al. |
| 2007/0031244 | A1 | 2/2007 | Ruthemeyer et al. |
| 2007/0031255 | A1 | 2/2007 | Ruthemeyer et al. |
| 2008/0127491 | A1 | 6/2008 | Lee et al. |
| 2008/0131259 | A1 | 6/2008 | Lee et al. |
| 2008/0131262 | A1 | 6/2008 | Lee et al. |
| 2008/0131263 | A1 | 6/2008 | Lee et al. |
| 2008/0131264 | A1 | 6/2008 | Lee et al. |
| 2008/0206042 | A1 | 8/2008 | Lee et al. |
| 2009/0155051 | A1 | 6/2009 | Lee et al. |
| 2009/0232660 | A1 | 9/2009 | Liang |
| 2010/0034647 | A1 | 2/2010 | Lee et al. |
| 2010/0074745 | A1 | 3/2010 | Jones et al. |
| 2012/0051930 | A1 | 3/2012 | Pandey et al. |
| 2012/0177479 | A1 | 7/2012 | Azad et al. |

FOREIGN PATENT DOCUMENTS

| | | | |
|---|---|---|---|
| EP | 0894946 | A1 | 2/1999 |
| EP | 0937863 | A2 | 8/1999 |
| EP | 2610437 | A2 | 7/2013 |
| JP | H09280002 | A | 10/1997 |
| WO | 9417285 | A1 | 8/1994 |

* cited by examiner

INNER SHROUD

OUTER SHROUD

COOLED TURBINE VANE PLATFORM COMPRISING FORWARD, MIDCHORD AND AFT COOLING CHAMBERS IN THE PLATFORM

FIELD OF THE INVENTION

This invention is directed generally to turbine airfoils, and more particularly to cooling systems in platforms of hollow turbine airfoils usable in turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. Likewise, the endwalls of the turbine vanes are exposed to the same high temperature combustor gases. It has been determined that fouling negatively impacts the ability of film cooling holes to provide a protective layer of cooling air immediately outward of the inner and outer endwalls, as shown in FIGS. 1-7. In particular, aft impingement pockets have been determined to collect debris and to clog and plug film cooling holes extending from the aft impingement pockets to an outer surface. The plugged film cooling holes cause high thermal gradients to form during operation and shortened lifespan of the endwall.

SUMMARY OF THE INVENTION

A cooling system positioned within a turbine airfoil usable in a turbine engine and having film cooling channels positioned within inner and outer endwalls of the turbine airfoil, with cooling fluids supplied to the film cooling channels other than from an aft cooling chamber to prevent blockages from developing within the film cooling channels from debris that typically collects with the aft cooling chamber during steady state operation of the turbine engine is disclosed. The cooling system may include one or more midchord cooling channels extending from a midchord cooling chamber and including an outlet positioned closer to a downstream edge of the inner endwall than an upstream wall forming the aft cooling chamber. The midchord cooling channel, thus, may cool aspects of the inner endwall radially outward of the aft cooling chamber without receiving cooling fluid from aft cooling chamber, thereby eliminating the possibility of blockages from debris in the aft cooling chamber.

In at least one embodiment, the turbine airfoil may be formed from a generally elongated, hollow airfoil having a leading edge, a trailing edge, a pressure side, a suction side, an inner endwall at a first end and an outer endwall at a second end that is generally on an opposite side of the generally elongated hollow airfoil from the first end, and a cooling system formed from at least one cavity in the elongated, hollow airfoil. The inner endwall may include one or more aft cooling chambers and one or more midchord cooling chambers positioned upstream from the aft cooling chamber. The aft cooling chamber may be positioned between the midchord cooling chamber and a downstream edge of the inner endwall. The cooling system may include a midchord film cooling channel extending from the at least one midchord cooling chamber, wherein the at least one midchord film cooling channel has at least one inlet in the at least one midchord cooling chamber and at least one outlet positioned closer to a downstream edge of the inner endwall than an upstream wall forming the at least one aft cooling chamber, thereby placing the at least one outlet of the at least one midchord film cooling channel downstream of the upstream wall forming the at least one aft cooling chamber. An outer surface of the inner endwall that intersects with the generally elongated, hollow airfoil may be perforationless without any outlet from a channel extending from the at least one aft cooling chamber. As such, the aft cooling chamber does not include film cooling channels with outlets in the outer surface of the inner endwall that could be susceptible to blockage.

The cooling system may also include one or more aft film cooling channels extending from the aft cooling chamber to one or more outlets at a downstream edge of the inner endwall. In at least one embodiment, the aft film cooling channel extending from the aft cooling chamber to the outlet at a downstream edge of the inner endwall comprises a plurality of aft film cooling channels extending from the aft cooling chamber, wherein each aft film cooling channel has an outlet in the downstream edge.

The outlet of the midchord film cooling channel may be positioned in an outer surface of the inner endwall that intersects with the generally elongated, hollow airfoil. The outlet of the midchord film cooling channel may be positioned radially outward of the at least one aft cooling chamber. One or more branch midchord film cooling channels may extend from the midchord film cooling chamber and may include an outlet in an outer surface of the inner endwall that intersects with the generally elongated, hollow airfoil. The outlet of the branch midchord film cooling channel may be positioned radially outward of the aft cooling chamber.

In at least one embodiment, the midchord film cooling channel includes one or more midchord film cooling channels positioned in the inner endwall outward of the pressure side of the generally elongated, hollow airfoil and one or more midchord film cooling channels positioned in the inner endwall outward of the suction side of the generally elongated, hollow airfoil. A plurality of film cooling channels may have outlets at a first mate face extending between an upstream edge and a downstream edge of the inner endwall.

The outer endwall may include a plurality of film cooling holes extending from inlets in one or more outer endwall cooling chambers to an outer surface of the outer endwall that intersects with the generally elongated, hollow airfoil. The plurality of film cooling holes in the outer endwall may include a row of downstream edge film cooling exhaust orifices in the outer surface of the outer endwall and may be positioned proximate to and upstream from a downstream edge of the outer endwall, a row of upstream edge film cooling exhaust orifices in the outer surface of the outer endwall and positioned proximate to and downstream from an upstream edge of the outer endwall, and a plurality of leading edge film cooling exhaust orifices in the outer surface of the outer endwall and positioned proximate to and upstream from an intersection of the leading edge of the generally elongated, hollow airfoil and the outer endwall. In at least one embodiment, the row of downstream edge film cooling exhaust orifices may include less than 15 downstream edge film cooling exhaust orifices, wherein the row of upstream edge film cooling exhaust orifices may include less than 35 upstream edge film cooling exhaust orifices, and wherein the plurality of leading edge film cooling exhaust orifices may include less than 6 leading edge film cooling exhaust orifices.

During use, cooling fluids may be supplied from a compressor or other cooling fluid source to the midchord cooling chamber within the inner endwall. The cooling fluid may then be passed into the inlets of the midchord cooling channels and flow through the midchord cooling channels, wherein the cooling fluids are exhausted through the outlets in the outer surface of the inner endwall. The cooling fluids may also be exhausted through the branch midchord cooling channel through the outlet to further cool aspects of the inner endwall proximate to the aft cooling chamber. Cooling fluids from midchord cooling chamber may also be exhausted from the outlets on the first mate face. The cooling fluids may be supplied to the aft cooling chamber and expelled through the aft cooling channels with outlets in the downstream edge of the inner endwall.

Cooling fluids may also be supplied from a compressor or other cooling fluid source to the outer endwall cooling chamber within the outer endwall. The cooling fluids may be exhausted through one or more of the plurality of film cooling holes extending from inlets in the one or more outer endwall cooling chambers to the outer surface of the outer endwall that intersects with the generally elongated, hollow airfoil. In particular, cooling fluids may flow through the row of downstream edge film cooling exhaust orifices in the outer surface of the outer endwall, the row of upstream edge film cooling exhaust orifices in the outer surface of the outer endwall, and the plurality of leading edge film cooling exhaust orifices in the outer surface of the outer endwall. The cooling fluids may be exhausted from the downstream edge film cooling exhaust orifices, the upstream edge film cooling exhaust orifices, the leading edge film cooling exhaust orifices, the pressure side outer endwall cooling orifices and the suction side outer endwall cooling orifices to form a film of cooling fluids along the outer surface of the outer endwall.

An advantage of the cooling system is that the cooling system provides film cooling air radially outward of the aft cooling chamber without the use of cooling channels extending from the aft cooling chamber, thereby eliminating the possibility of blockages from debris in the aft cooling chamber.

Another advantage of the cooling system is that the total number of film cooling outlets in the inner endwall and the outer endwall, as shown in FIGS. 10 and 14, is less than most conventional systems, as shown in FIGS. 9 and 13, which reduces manufacturing costs.

Yet another advantage of the cooling system is that the diameter of the film cooling outlets in the inner endwall and the outer endwall is larger than convention outlets, thereby reducing the likelihood of blockages forming from debris and enabling the number of cooling holes to be reduced while still providing the same or large volume of cooling fluids, thereby reducing manufacturing costs and improving cooling fluid film coverage together.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
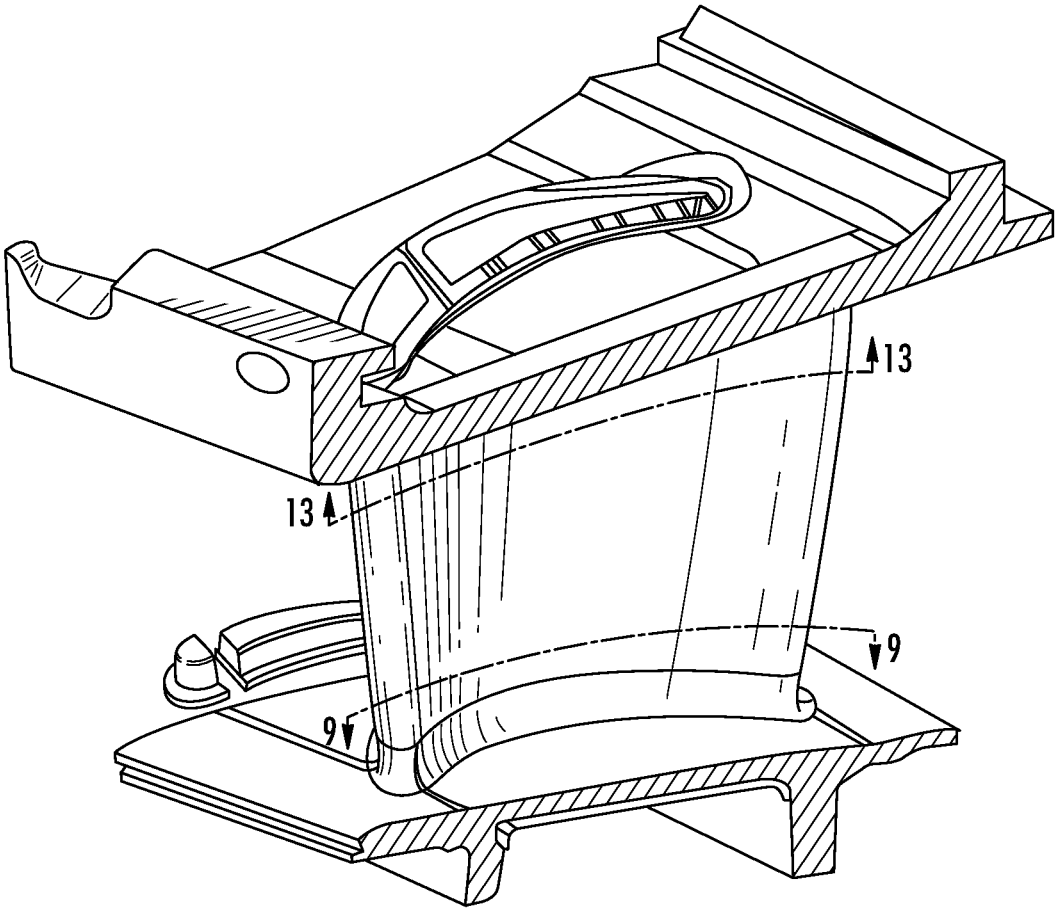
FIG. 1 (PRIOR ART)
FIG. 1 is a perspective view of the pressure side of a conventional turbine airfoil.
Figure 3:
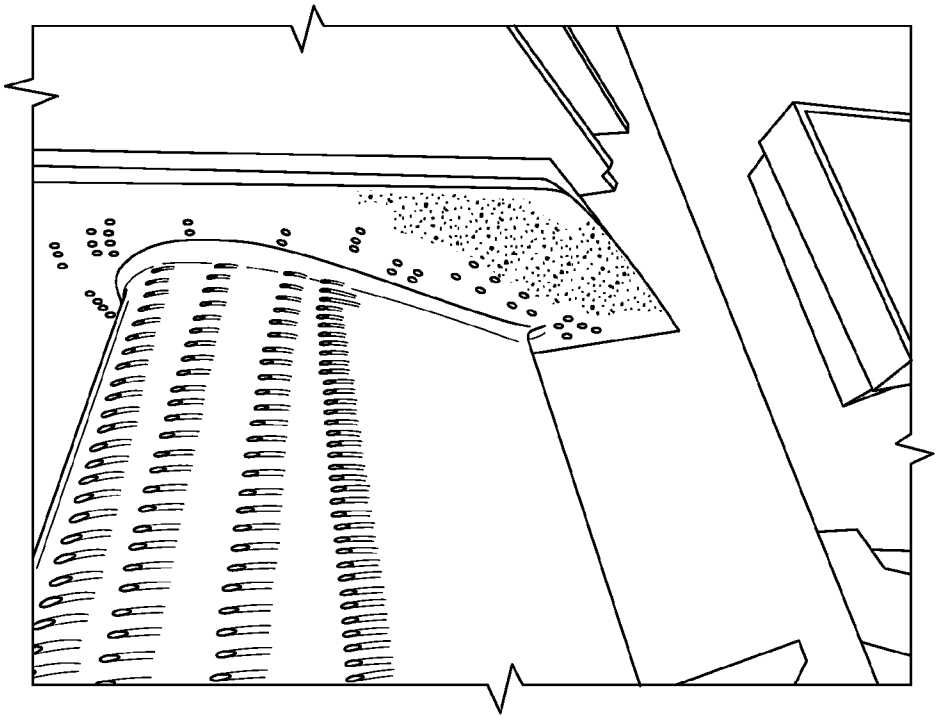
FIG. 3 (PRIOR ART)
FIG. 3 is a partial perspective view of an airfoil and the endwall with the problem area with plugged film cooling holes identified.
Figure 2:
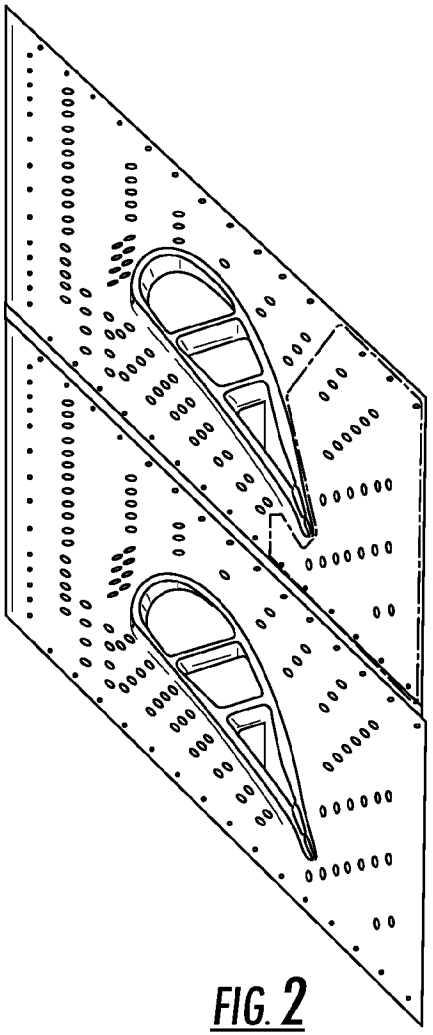
FIG. 2 (PRIOR ART)
FIG. 2 is a top view of endwalls of two airfoils with the problem area with plugged film cooling holes identified.
Figure 5:
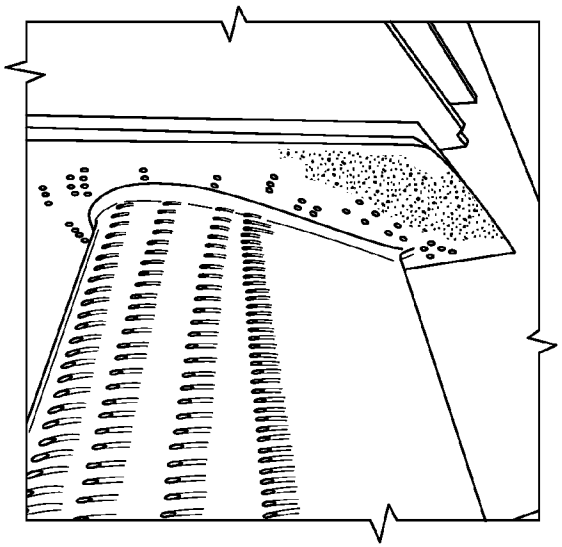
FIG. 5 (PRIOR ART)
FIG. 5 is another partial perspective view of an airfoil and the endwall with the problem area with plugged film cooling holes.
Figure 7:
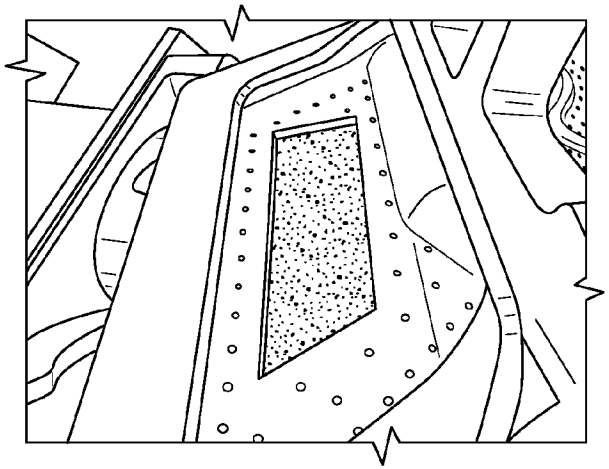
FIG. 7 (PRIOR ART)
FIG. 7 is another cutaway view of the impingement cooling chamber in the endwall where debris was located that plugged the film cooling holes.
Figure 4:
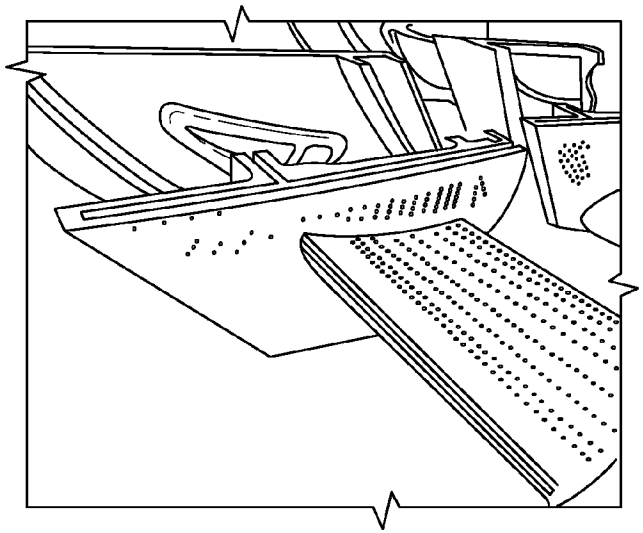
FIG. 4 (PRIOR ART)
FIG. 4 is a partial perspective view of an airfoil and the endwall with the problem area with plugged film cooling holes identified and a damaged mateface.
Figure 6:
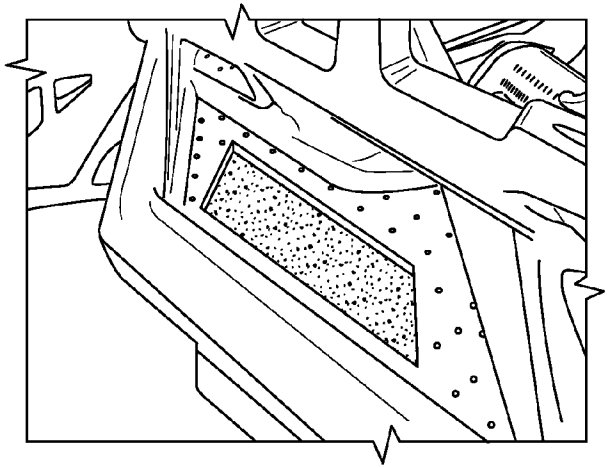
FIG. 6 (PRIOR ART)
FIG. 6 is a cutaway view of the impingement cooling chamber in the endwall where debris was located that plugged the film cooling holes.
Figure 8:
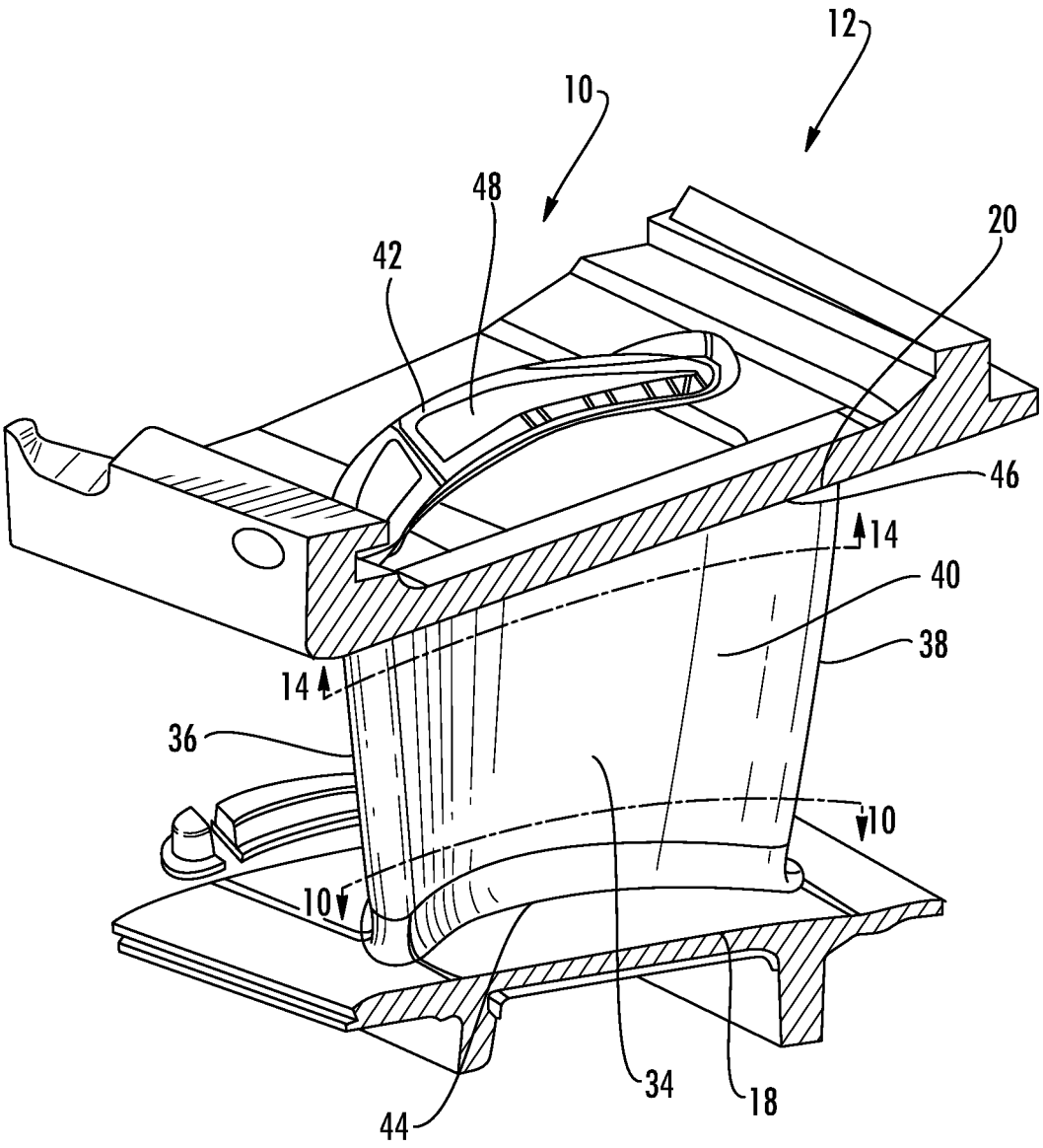
FIG. 8 is a perspective view of the pressure side of a turbine airfoil having features of the cooling system.
Figure 9:
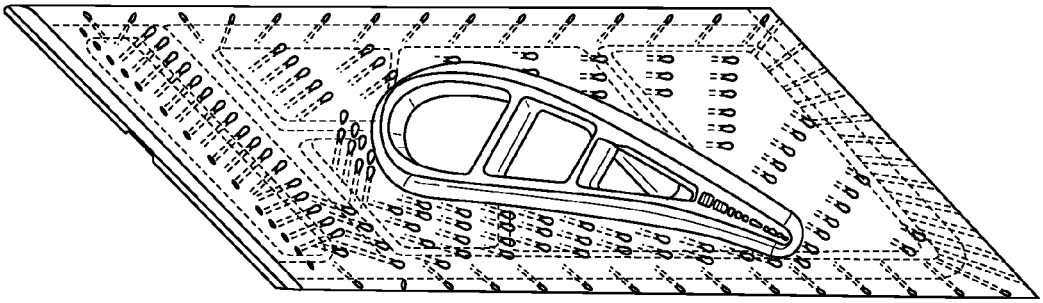
FIG. 9 (PRIOR ART)
FIG. 9 is a cross-sectional view of the inner shroud of a conventional airfoil taken at section line 9-9 in FIG. 1.

As shown in FIGS. 8, 10-12 and 14, a cooling system 10 positioned within a turbine airfoil 12 usable in a turbine engine and having film cooling channels 16 positioned within inner and outer endwalls 18, 20 of the turbine airfoil 12, with cooling fluids supplied to the film cooling channels 16 other than from an aft cooling chamber 22 to prevent blockages from developing within the film cooling channels 16 from debris that typically collects with the aft cooling chamber 22 during steady state operation of the turbine engine is disclosed. The cooling system 10 may include one or more midchord cooling channels 24 extending from a midchord cooling chamber 26 and including an outlet 28 positioned closer to a downstream edge 30 of the inner endwall 18 than an upstream wall 32 forming the aft cooling chamber 22. The midchord cooling channel 24, thus, may cool aspects of the inner endwall 18 radially outward of the aft cooling chamber 22 without receiving cooling fluid from aft cooling chamber 22, thereby eliminating the possibility of blockages from debris in the aft cooling chamber 22.

In at least one embodiment, the turbine airfoil 12 may be formed from a generally elongated, hollow airfoil 34 having a leading edge 36, a trailing edge 38, a pressure side 40, a suction side 42, an inner endwall 18 at a first end 44 and an outer endwall 20 at a second end 46 that is generally on an opposite side of the generally elongated hollow airfoil 34 from the first end 44, and a cooling system 10 formed from at least one cavity 48 in the elongated, hollow airfoil 34. The inner endwall 18 may include one or more aft cooling chambers 22 and one or more midchord cooling chambers 26 positioned upstream from the aft cooling chamber 22. The aft cooling chamber 22 may be positioned between the midchord cooling chamber 26 and the downstream edge 30 of the inner endwall 18. The midchord film cooling channel 24 may extend from one or more midchord cooling chambers 26. The midchord film cooling channel 24 may have one or more inlets 50 in the midchord cooling chamber 26 and outlets 28 positioned closer to a downstream edge 30 of the inner endwall 18 than an upstream wall 32 forming the aft cooling chamber 22, thereby placing the outlet 28 of the midchord film cooling channel 24 downstream of the upstream wall 32 forming the aft cooling chamber 22. An outer surface 52 of the inner endwall 18 that intersects with the generally elongated, hollow airfoil 34 may be perforationless without any outlet from a channel extending from the aft cooling chamber 22. In particular, the cooling system 10 does not include a cooling channel within an inlet in the aft cooling chamber 22 and an outer in the outer surface 52.

The cooling system 10 may include one or more aft film cooling channels 54 extending from the aft cooling chamber 22 to one or more outlets 56 at a downstream edge 30 of the inner endwall 18. In at least one embodiment, the cooling system 10 may include a plurality of aft film cooling channels 54 extending from the aft cooling chamber 22, wherein each aft film cooling channel 22 may have an outlet 28 in the downstream edge 30. The outlet 28 of the midchord film cooling channel 24 may be positioned in an outer surface 52 of the inner endwall 18 that intersects with the generally elongated, hollow airfoil 34. The outlet 28 of the midchord film cooling channel 24 may be positioned radially outward of the aft cooling chamber 22. One or more branch midchord film cooling channels 58 may extend from the midchord film cooling chamber 26 and including an outlet 60 in the outer surface 52 of the inner endwall 18 that intersects with the generally elongated, hollow airfoil 34. The outlet 60 of the branch midchord film cooling channel 58 may be positioned radially outward of the aft cooling chamber 22.

Figure 10:
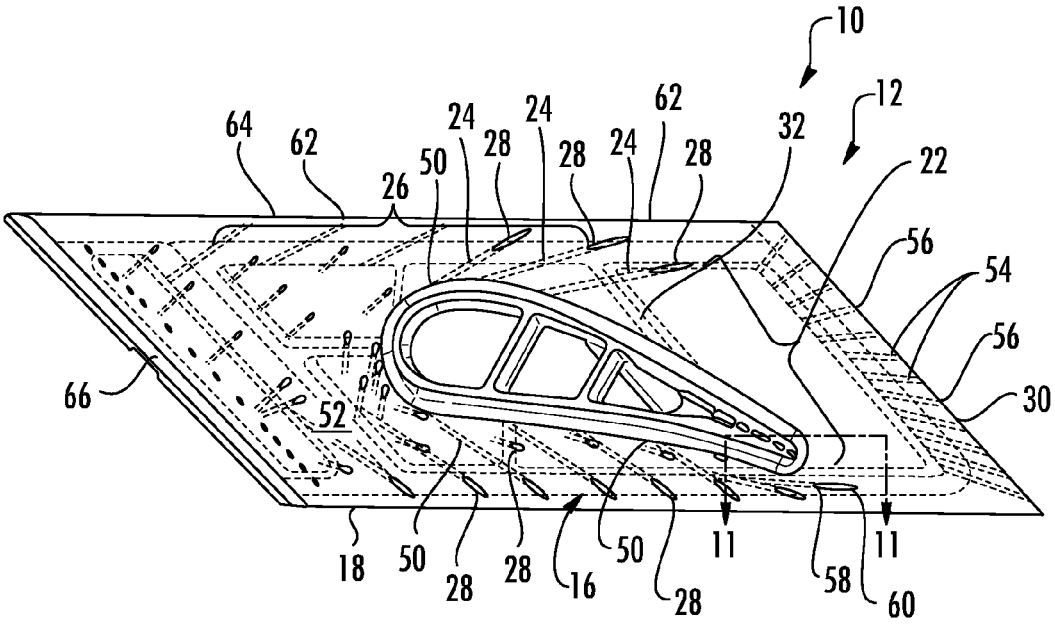
FIG. 10 is a cross-sectional view of the inner endwall having features of the cooling system taken at section line 10-10 in FIG. 8.
Figure 11:
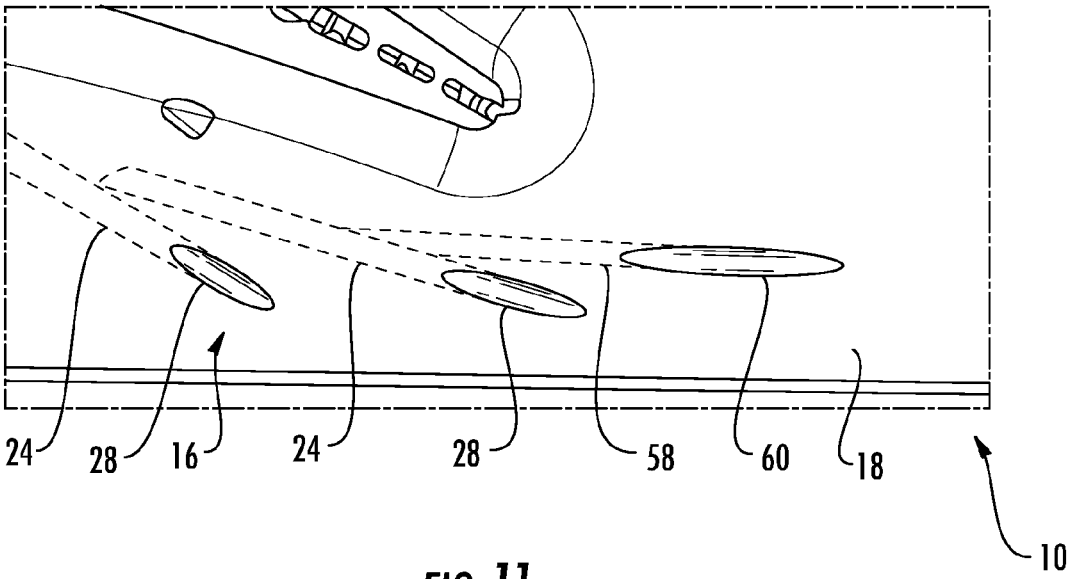
FIG. 11 is a detail cross-sectional view of the inner endwall having features of the cooling system taken at section line 11-11 in FIG. 10.
Figure 12:
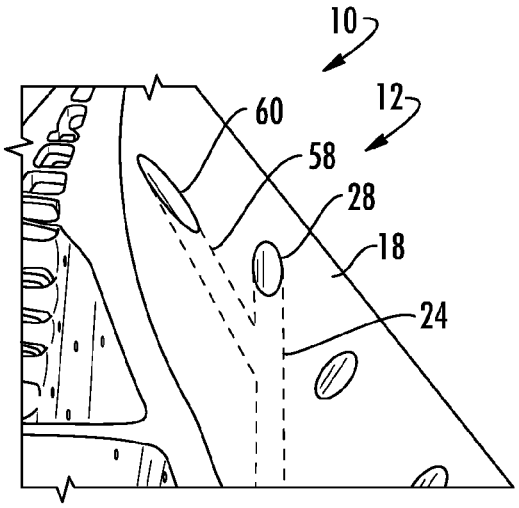
FIG. 12 is another detail cross-sectional view of the inner endwall having features of the cooling system.
Figure 13:
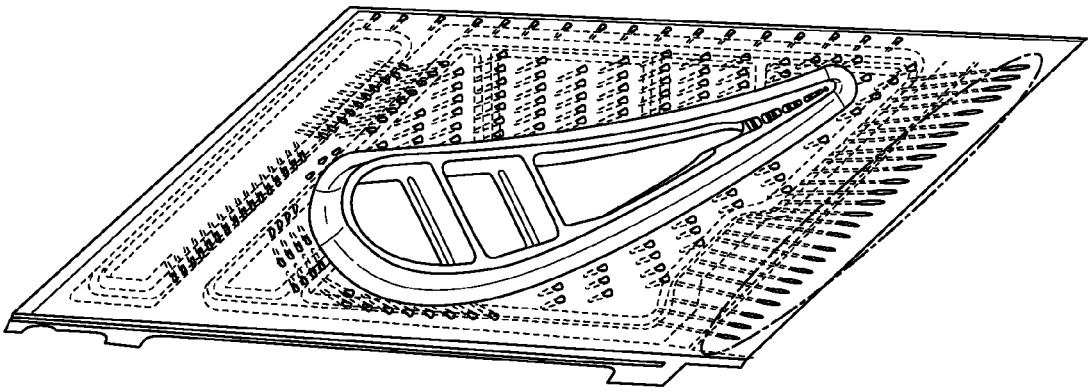
FIG. 13 (PRIOR ART)
FIG. 13 is a cross-sectional view of the outer shroud of a conventional airfoil taken at section line 13-13 in FIG. 1.

As shown in FIGS. 10-12, the cooling system 10 may include one or more midchord film cooling channels 24 positioned in the inner endwall 18 outward of the pressure side 40 of the generally elongated, hollow airfoil 34 and one or more midchord film cooling channels 24 positioned in the inner endwall 18 outward of the suction side 42 of the generally elongated, hollow airfoil 34. In another embodiment, the cooling system 10 may include a plurality of midchord film cooling channels 24 positioned in the inner endwall 18 outward of the pressure side 40 of the generally elongated, hollow airfoil 34 and a plurality of midchord film cooling channels 24 positioned in the inner endwall 18 outward of the suction side 42 of the generally elongated, hollow airfoil 34. The cooling system 10 may also include a plurality of film cooling channels having outlets 62 at a first mate face 64 extending between an upstream edge 66 and the downstream edge 30 of the inner endwall 18. In at least one embodiment, the first mate face 64 may be on the suction side 42 of the generally elongated, hollow airfoil 34.

Figure 14:
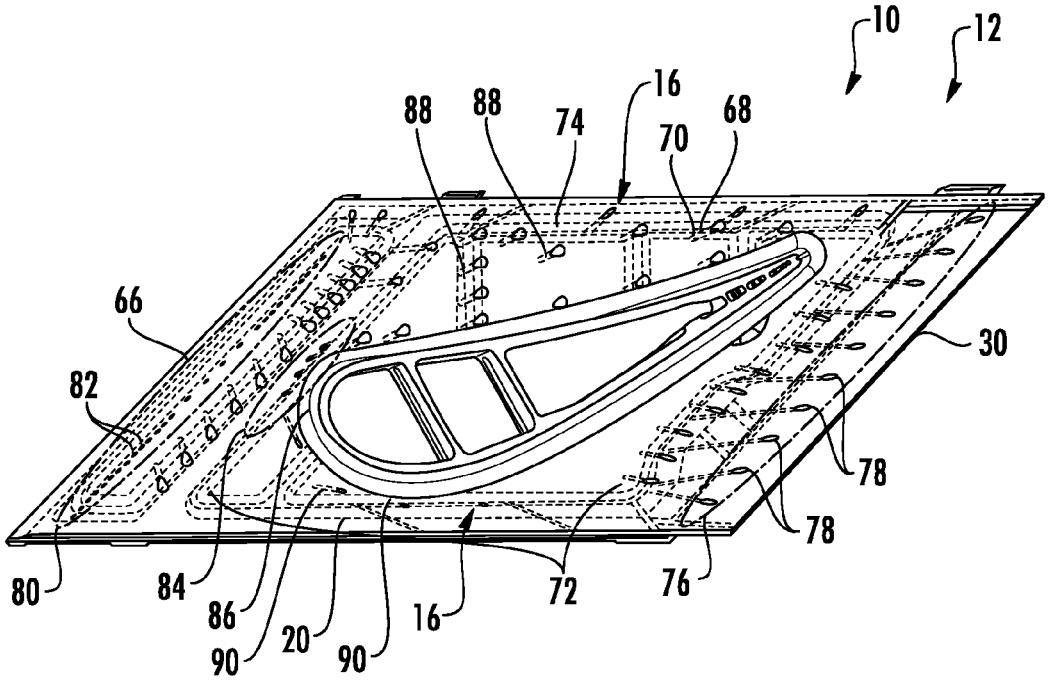
FIG. 14 is a cross-sectional view of the outer endwall having features of the cooling system taken at section line 14-14 in FIG. 8.

As shown in FIG. 14, the outer endwall 20 may include portions of the cooling system 10. In particular, the outer endwall 20 may include a plurality of film cooling holes 68 extending from inlets 70 in one or more outer endwall cooling chambers 72 to an outer surface 74 of the outer endwall 20 that intersects with the generally elongated, hollow airfoil 34. The plurality of film cooling holes 68 in the outer endwall 20 may include a row 76 of downstream edge film cooling exhaust orifices 78 in the outer surface 74 of the outer endwall 20 and positioned proximate to and upstream from the downstream edge 30 of the outer endwall 20, a row 80 of upstream edge film cooling exhaust orifices 82 in the outer surface 74 of the outer endwall 20 and positioned proximate to and downstream from an upstream edge 66 of the outer endwall 20, and a plurality of leading edge film cooling exhaust orifices 84 in the outer surface 74 of the outer endwall 20 and positioned proximate to and upstream from an intersection 86 of the leading edge 36 of the generally elongated, hollow airfoil 34 and the outer endwall 20. In at least one embodiment, the row 76 of downstream edge film cooling exhaust orifices 78 may include less than 15 downstream edge film cooling exhaust orifices 78. In at least one embodiment, the row 76 of downstream edge film cooling exhaust orifices 78 may include ten or fewer downstream edge film cooling exhaust orifices 78. The downstream edge film cooling exhaust orifices 78 may have a diameter of between about one millimeter and about 1.5 millimeters.

The row 80 of upstream edge film cooling exhaust orifices 82 in the outer surface 74 of the outer endwall 20 may include less than 35 upstream edge film cooling exhaust orifices 82 in the outer surface 74. In another embodiment, the row 80 of upstream edge film cooling exhaust orifices 82 in the outer surface 74 of the outer endwall 20 may include less than 32 upstream edge film cooling exhaust orifices 82 in the outer surface 74. The upstream edge film cooling exhaust orifices 82 may have a diameter of between 0.5 millimeters and 1.0 millimeters.

In at least one embodiment, the plurality of leading edge film cooling exhaust orifices 84 in the outer surface 74 of the outer endwall 20 may include 10 or fewer leading edge film cooling exhaust orifices 84. In another embodiment, the plurality of leading edge film cooling exhaust orifices 84 in the outer surface 74 of the outer endwall 20 may include less than six leading edge film cooling exhaust orifices 84. The leading edge film cooling exhaust orifices 84 may have a diameter of between 0.5 millimeters and 1.0 millimeters. The film cooling holes 68 in portions of the outer endwall 20 other than the row 76 of downstream edge film cooling exhaust orifices 78, the row 80 of upstream edge film cooling exhaust orifices 82 and leading edge film cooling exhaust orifices 84 may have a diameter between about 1.5 millimeters and about 2.5 millimeters. The plurality of film cooling holes 68 in the outer endwall 20 may include a plurality of pressure side outer endwall cooling orifices 88 and a plurality of suction side outer endwall cooling orifices 90.

During use, cooling fluids may be supplied from a compressor or other cooling fluid source to the midchord cooling chamber 26 within the inner endwall 18. The cooling fluid may then be passed into the inlets 50 of the midchord cooling channels 24 and flow through the midchord cooling channels 24, wherein the cooling fluids are exhausted through the outlets 28 in the outer surface 52 of the inner endwall 18. The cooling fluids may also be exhausted through the branch midchord cooling channel 58 through the outlet to further cool aspects of the inner endwall 18 proximate to the aft cooling chamber 22. Cooling fluids from midchord cooling chamber 26 may also be exhausted from the outlets 62 on the first mate face 64. The cooling fluids may be supplied to the aft cooling chamber 22 and expelled through the aft cooling channels 54 with outlets 56 in the downstream edge 30 of the inner endwall 18.

Cooling fluids may also be supplied from a compressor or other cooling fluid source to the outer endwall cooling chamber 72 within the outer endwall 20. The cooling fluids may be exhausted through one or more of the plurality of film cooling holes 68 extending from inlets 70 in the one or more outer endwall cooling chambers 72 to the outer surface 74 of the outer endwall 20 that intersects with the generally elongated, hollow airfoil 34. In particular, cooling fluids may flow through the row 76 of downstream edge film cooling exhaust orifices 78 in the outer surface 74 of the outer endwall 20, the row 80 of upstream edge film cooling exhaust orifices 82 in the outer surface 74 of the outer endwall 20, and the plurality of leading edge film cooling exhaust orifices 84 in the outer surface 74 of the outer endwall 20. The cooling fluids may be exhausted from the downstream edge film cooling exhaust orifices 78, the upstream edge film cooling exhaust orifices 82, the leading edge film cooling exhaust orifices 84, the pressure side outer endwall cooling orifices 88 and the suction side outer endwall cooling orifices 90 to form a film of cooling fluids along the outer surface 74 of the outer endwall 20.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated, hollow airfoil having a leading edge, a trailing edge, a pressure side, a suction side, an inner endwall at a first end and an outer endwall at a second end that is generally on an opposite side of the generally elongated hollow airfoil from the first end, and a cooling system formed from at least one cavity in the elongated, hollow airfoil;

wherein the inner endwall includes at least one aft cooling chamber and at least one midchord cooling chamber positioned upstream from the at least one aft cooling chamber;

wherein the at least one aft cooling chamber is positioned between the at least one midchord cooling chamber and a downstream edge of the inner endwall;

at least one midchord film cooling channel extending from the at least one midchord cooling chamber, wherein the at least one midchord film cooling channel has at least one inlet in the at least one midchord cooling chamber and at least one outlet positioned closer to the downstream edge of the inner endwall than an upstream wall forming the at least one aft cooling chamber, thereby placing the at least one outlet of the at least one midchord film cooling channel downstream of the upstream wall forming the at least one aft cooling chamber; and wherein an outer surface of the inner endwall that intersects with the generally elongated, hollow airfoil is perforationless without any outlet from a channel extending from the at least one aft cooling chamber.

2. The turbine airfoil of claim 1, further wherein at least one aft film cooling channel extending from the at least one aft cooling chamber to at least one outlet at a downstream edge of the inner endwall.

3. The turbine airfoil of claim 2, wherein the at least one aft film cooling channel extending from the at least one aft cooling chamber to at least one outlet at a downstream edge of the inner endwall comprises a plurality of aft film cooling channels extending from the at least one aft cooling chamber, wherein each aft film cooling channel has an outlet in the downstream edge.

4. The turbine airfoil of claim 1, wherein the at least one outlet of the at least one midchord film cooling channel is positioned in an outer surface of the inner endwall that intersects with the generally elongated, hollow airfoil.

5. The turbine airfoil of claim 1, wherein the at least one outlet of the at least one midchord film cooling channel is positioned radially outward of the at least one aft cooling chamber.

6. The turbine airfoil of claim 1, further wherein at least one branch midchord film cooling channel extending from the at least one midchord film cooling chamber and including an outlet in an outer surface of the inner endwall that intersects with the generally elongated, hollow airfoil.

7. The turbine airfoil of claim 6, wherein the outlet of the at least one branch midchord film cooling channel is positioned radially outward of the at least one aft cooling chamber.

8. The turbine airfoil of claim 1, wherein the at least one midchord film cooling channel includes at least one midchord film cooling channel positioned in the inner endwall outward of the pressure side of the generally elongated, hollow airfoil and at least one midchord film cooling channel positioned in the inner endwall outward of the suction side of the generally elongated, hollow airfoil.

9. The turbine airfoil of claim 1, further wherein a plurality of film cooling channels having outlets at a first mate face extending between an upstream edge and a downstream edge of the inner endwall.

10. The turbine airfoil of claim 1, wherein the outer endwall comprises a plurality of film cooling holes extending from inlets in at least one outer endwall cooling chamber to an outer surface of the outer endwall that intersects with the generally elongated, hollow airfoil.

11. The turbine airfoil of claim 10, wherein the plurality of film cooling holes in the outer endwall include a row of downstream edge film cooling exhaust orifices in the outer surface of the outer endwall and positioned proximate to and upstream from a downstream edge of the outer endwall, a row of upstream edge film cooling exhaust orifices in the outer surface of the outer endwall and positioned proximate to and downstream from an upstream edge of the outer endwall, and a plurality of leading edge film cooling exhaust orifices in the outer surface of the outer endwall and positioned proximate to and upstream from an intersection of the leading edge of the generally elongated, hollow airfoil and the outer endwall.

12. The turbine airfoil of claim 11, wherein the row of downstream edge film cooling exhaust orifices includes less than 15 downstream edge film cooling exhaust orifices, wherein the row of upstream edge film cooling exhaust orifices includes less than 35 upstream edge film cooling exhaust orifices, and wherein the plurality of leading edge film cooling exhaust orifices include less than six leading edge film cooling exhaust orifices.

* * * * *